United States Patent [19]

Falk

[11] 3,952,565

[45] Apr. 27, 1976

[54] HARDENABLE LOCK

[75] Inventor: Morris Falk, Palm Springs, Calif.

[73] Assignee: Fort Lock Corporation, River Grove, Ill.

[22] Filed: Oct. 17, 1974

[21] Appl. No.: 515,580

[52] U.S. Cl. ..... 70/417; 70/52

[51] Int. Cl.[2] ..... E05B 67/04

[58] Field of Search ..... 70/38 R, 38 A, 38 B, 70/38 C, 53, 52, 417

[56] References Cited

UNITED STATES PATENTS 3,789,639 2/1974 Canter ..... 70/437

*Primary Examiner*—Robert L. Wolfe

*Attorney, Agent, or Firm*—Wolfe, Hubbard, Leydig, Voit & Osann, Ltd.

[57] ABSTRACT

A maximum security padlock of the type having a monolithic lock body or case with a plurality of shackle and lock-receiving bores therein is made of a compressed and sintered powder metal alloy of an austenitic stainless steel. As a consequence of this unique material, the lock body is readily made with most or all of the bores formed in compressing the powder metal. While the resulting sintered lock body is relatively, substantially, softer than a conventional lock body and the shackle, when an attempt is made to saw or otherwise cut through the body the stainless steel work-hardens to resist and slow down further cutting. Improvements in the lock mechanism augment the characteristics provided by powder metal fabrication.

6 Claims, 7 Drawing Figures

HARDENABLE LOCK

DESCRIPTION OF THE INVENTION

This invention relates generally to maximum security padlocks, and more particularly concerns the provision of a maximum security padlock that can readily be fabricated at low cost.

The term "maximum security" has an accepted meaning in the lock industry. It denotes a superior quality lock specifically designed to withstand concerted assaults, both physical and with lock picking techniques, by professional criminals. Maximum security padlocks are used in locations where, because of the value of the goods or premises and the forseeability of thievery, a lock must be provided with the expectation that its security features will be put to the test.

Lock manufacturers have in general been able to supply high quality maximum security padlocks, but this has not been accomplished at low cost. One of the most expensive components of a maximum security padlock is usually the padlock body; readily machineable materials such as brass or bronze are simply too vulnerable to a cutting tool, i.e. drill or hacksaw, and die castings succumb to either tool or, indeed, to a hammer. Laminated steel lock bodies yield to the cold chisel.

As a consequence, monolithic ("solid") steel bodies are used almost exclusively in maximum security padlock construction. Steel, unfortunately, must be drilled to provide the necessary shackle-receiving and lock-receiving bores; drilling must be performed before the steel is hardened, and the drilled body thereafter heat treated to achieve a burglar-resistant hardness. Moreover, the hardened lock must thereafter be chrome or cadmium plated for corrosion resistance; plating is expensive, and cannot always protect the internal bores and cavities in the lock body.

Accordingly, a principal object of the invention is to provide a maximum security padlock which has a low cost, readily fabricated, monolithic lock body.

Another object is to provide a maximum security padlock having a monolithic lock body with most of the required bores being made without the need for drilling into the body. A related object is to provide such padlock with a body that does not require chrome or other plating for corrosion resistance, and which has corrosion-resistant internal cavities and bores.

Still a further object is to provide a lock construction which is uniquely able to utilize the features of a lock body from which most of the heretofore-conventional drilling operations have been eliminated.

Yet an additional object is to provide a monolithic lock body for a maximum security padlock which is initially substantially softer than the conventional hardened steel shackles, but which, when an attempt is made to saw or drill through the body, work-hardened to resist further sawing or drilling.

Other objects and advantages of the invention will become apparent upon reading the following detailed description and upon reference to the drawings, in which.

While the invention will be described in connection with a preferred embodiment, it will be understood that it is not intended to limit the invention to that embodiment. On the contrary, it is intended to cover all alternatives, modifications and equivalents as may be included within the spirit and scope of the invention.

Figure 1:
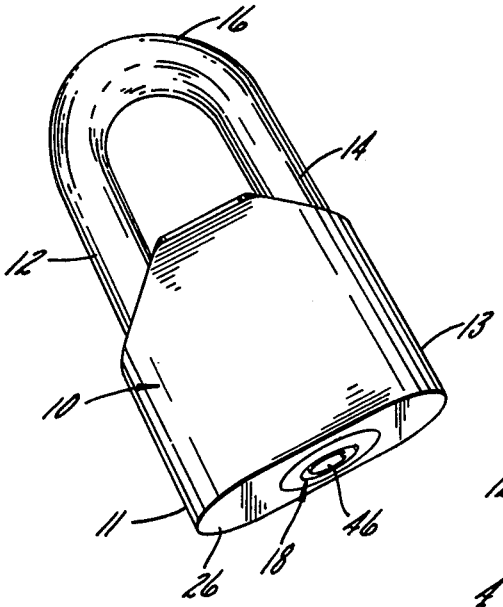
FIG. 1 is a view in perspective generally showing a lock embodying the present invention.

Turning to the figures, there is shown, in FIG. 1, a typical locking device incorporating the present invention, the lock here being a padlock 10 having a generally U-shaped hardened steel shackle 16, with a non-removable shackle leg 12 and a removable leg 14. When the lock is in its "locked" position, both legs 12, 14 of the shackle 16 are secured within the padlock 10 body (as shown in FIG. 2), and when the lock is open (as in FIG. 5), the relatively shorter, removable shackle leg 14 is free of the body 10 while the non-removable longer leg is partially extended but nonetheless securely retained.

In the present instance, a locking device generally indicated at 18 is of the axial pin tumbler type since it provides a rugged lock of high security, and the axial orientation of the pins, the annular keyway, and other factors make the lock resistant to picking or otherwise opening by unauthorized means. Locks of this general type are illustrated in U.S. Pat. Nos. 3,041,086 and 3,509,748. It will be understood, however, as the discussion proceeds that the present invention is not limited to use with axial pin tumbler type locking devices, but other types of locks may be used if desired.

Figure 2:
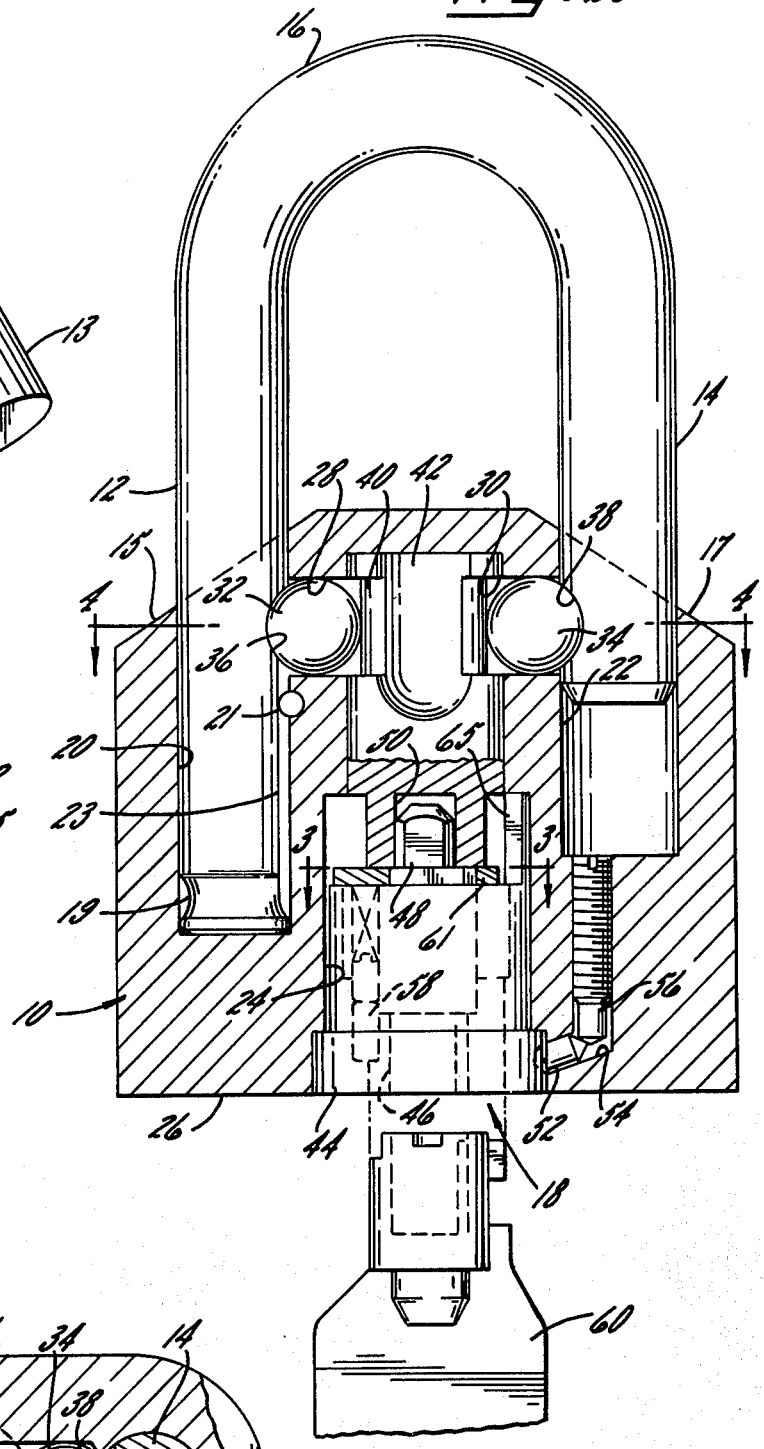
FIG. 2 is an enlarged partial sectional view of the lock portion of the device shown in FIG. 1, showing the interior parts in the "locked" position and illustrating a key to be inserted into the lock.

Referring to FIG. 2 the lock body 10 is of somewhat rectangular form with rounded sides 11, 13 and beveled upper corners 15, 17. The lock body 10 is provided with a pair of parallel spaced-apart bores 20, 22 extending from the top of the lock body and adapted to receive the shackle 16 legs 12, 14 respectively. A stepped bore 24 extends upward from the bottom 26 of the lock body 10, and is disposed between the shackle receiving bores 20, 22 and parallel therewith. A pair of axially aligned transverse passages 28, 30 interconnect the stepped bore 24 with the respective shackle-receiving bores 20, 22 near the top of the lock body 10.

Figure 4:
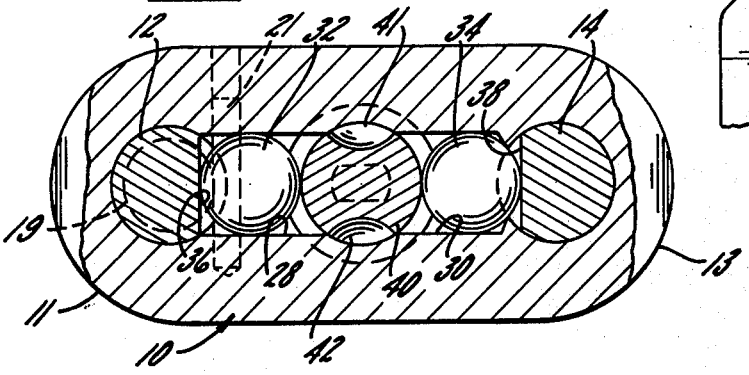
FIG. 4 is a sectional view taken substantially in the plane of line 4—4 in FIG. 2 showing the position of the lock parts when the padlock is locked.

In order to secure the shackle legs 12, 14 in their respective bores 20, 22, there is provided a pair of shackle-fixing hardened metal balls, 32, 34 disposed in the respective passages 28, 30, with the outer surfaces of the balls bearing against respective indentations 36, 38 in the shackles 12, 14. In the lock position of FIG. 2, the inner surfaces of the balls 32, 34 bear against the peripheral surface of a retaining member 40 disposed axially within the upper end of the bore 24. The arrangement is such (as best shown in FIG. 4) that the balls 32, 34 are held captive against the indentations 36, 38 of the shackle members 12, 14 by the retaining member 40, which offers no clearance for the shackles to be removed from the lock body 10. Such a construction prevents forceable withdrawal of the shackle 16 unless the force applied is so great as to physically tear apart the lock body 10.

Figure 7:
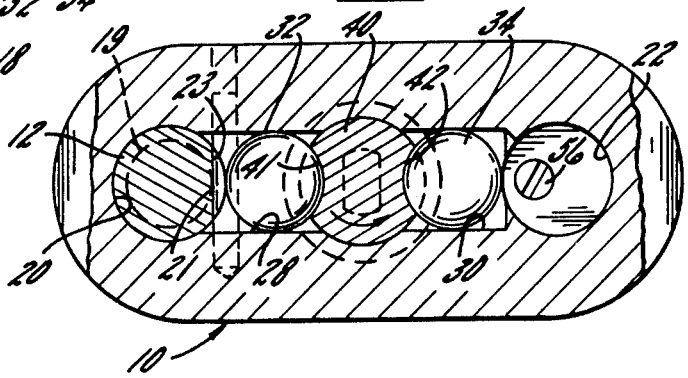
FIG. 7 is a sectional view taken substantially in the plane of line 7—7 in FIG. 5 showing the position of the lock parts in the "open" state.

In order to permit authorized removal of the shackle 16, a pair of indentations 41, 42 (see especially FIG. 4, and also FIG. 2) is provided on the retaining member 40 so that when the retaining member is rotated to a position where the indentations 41, 42 are aligned with the balls 32, 34 (FIGS. 5 and 7), the balls can move inwardly into the indentations so as to clear the respective indentations 32, 38 on the shackle 16. This allows lifting of the shackle 16 for a limited distance sufficient to free the short or removable shackle end 14 from its bore 22 and thus from the lock body.

In the illustrated device, as shown for example in FIG. 2, the lock mechanism 18 includes a casing 44 and a spindle 46 mounted for rotation within the casing. The inner end of the spindle 46 carries a protruding flat sided pin 48 which is received in a corresponding non-circular opening 50 in the retaining member 40. Accordingly, when the spindle 46 is rotated within the lock casing 44 the retaining member 40 is also rotated to bring the indentations 41, 42 in alignment with the balls 32, 34 for releasing the shackle 16. In order to secure the lock casing 44 to the lock body 10, a pin 52 received in a dog leg passage 54 is held against the lock casing 44 by a set screw 56.

The lock mechanism 18 is secured against unauthorized operation by a number of tumbler pins 58 arranged circumferentially around the axis of the lock mechanism which prevent rotation of the spindle 46 until a proper key 60 is inserted and aligns the tumbler pins with a radially oriented interface between the casing and the spindle. For details of the axial pin tumbler lock mechanism of the type useful in the present lock, reference is made to the aforementioned U.S. Pat. Nos. 3,415,086 and 3,509,748.

Figure 3:
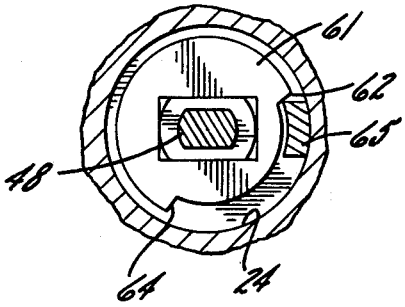
FIG. 3 is a sectional view taken substantially in the plane of line 3—3 in FIG. 2 and showing an optional cam which limits the rotation of the key between the lock and unlocked positions.
Figure 6:
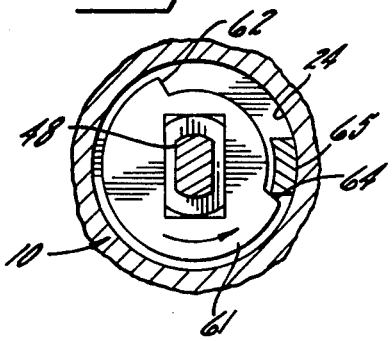
FIG. 6 is a sectional view taken substantially in the plane of line 6—6 in FIG. 5, here illustrating the cam in the "open" position.

Optionally, in order to limit the degree of rotation of the lock spindle 46 and the retainer 40 so that the indentations 41, 42 may not be moved in alignment with the balls 32, 34 to release the shackle 16, a cam plate 61 (FIGS. 2 and 3) is carried by the pin 48 and has abutment shoulders 62, 64 which act as a fixed stop 65 that limits the rotation of the spindle to 90° (FIG. 6).

Figure 5:
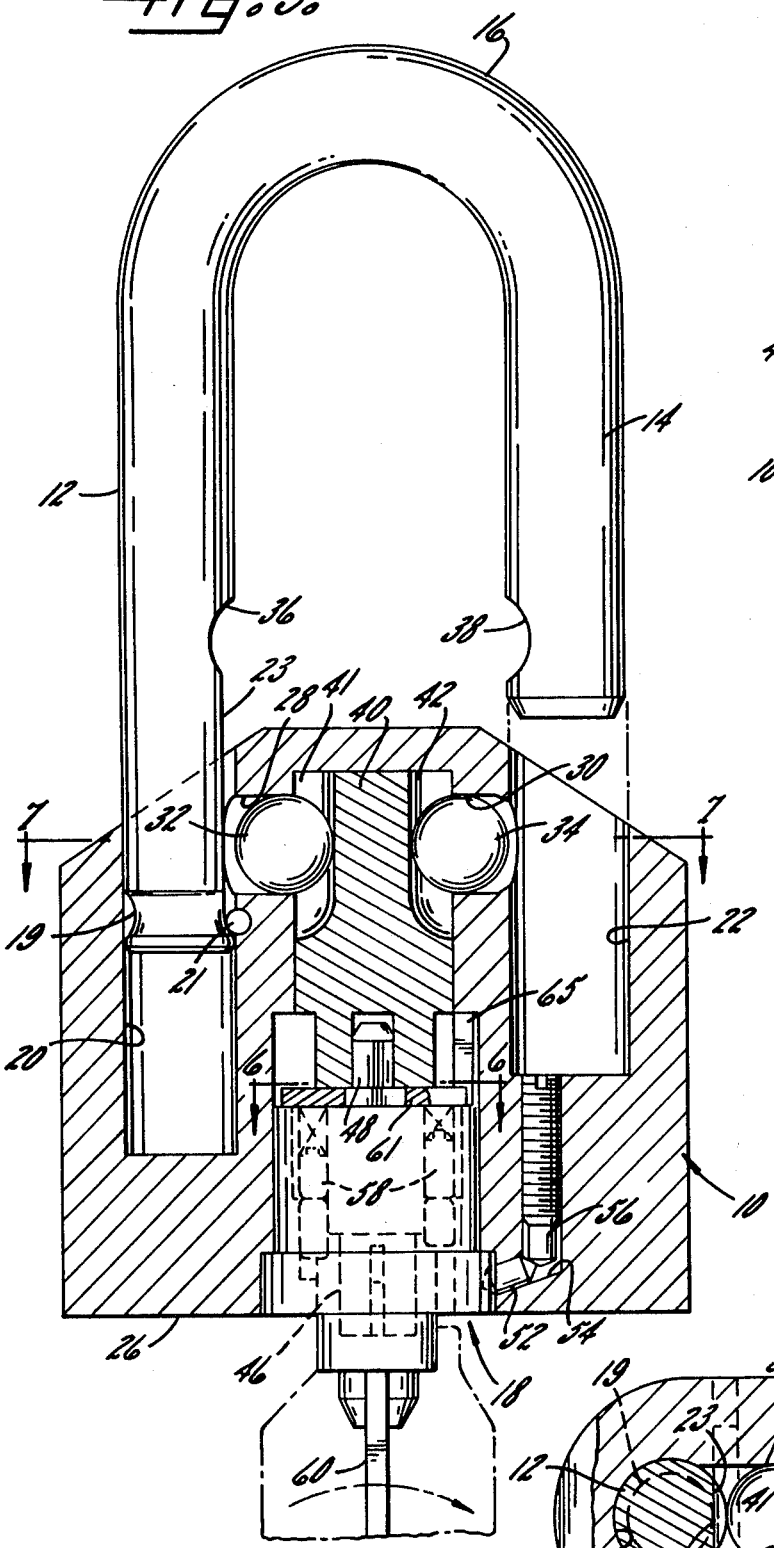
FIG. 5 is a sectional view similar to that of FIG. 2, here showing the key inserted and the lock in the "open" position with the shackle released from the lock body; the lock body.

FIG. 5 (and FIG. 6) depict the lock in its open position. The retainer 40 is turned 90° with respect to the lock position of FIG. 2, so that the balls 32, 34 can retract into the indentations 41, 42 of the retainer. When in such a position, the balls 32, 34 no longer are in engagement with the indentations 36, 38 of the shackle 16, thereby permitting the shackle to be lifted upward with respect to the lock body 10.

To permit limited upward lifting of the shackle 16 and to permit 360° rotation of the shackle with respect to the body, the longer, or non-removable, leg 12 of the shackle 16 is provided with an annular neck 19 near the extremity of the shackle, and with a flat portion 17 extending from the indentation 36 to the neck 19. A hardened steel pin 21 is press-fitted into a corresponding hole bored into the body 10 to cooperate with the flat 23 and permit vertical lifting of the shackle 16, and with the neck 19 to permit 360° of rotation of the shackle after it is in its nearly-fully lifted position.

In keeping with the invention, the lock body 10 is a monolithic structure made of a compressed and sintered powdered metal alloy, particularly one of the so-called non-hardening austenitic stainless steel of the type 300 series. Powder metal technology permits the entire lock body 10 to be made by compression and sintering so that the bores 20, 22, 24 may be formed integrally, without or with only minor boring or finishing operations, during compression of the powder metal.

The type 300 stainless steels being austenitic, they are not hardenable by thermal hardening treatment, and for this reason have largely been rejected as components of maximum security locks. They are, however, subject to strain or work hardening. Thus, their initial softness, while substantially less than that of the hardened steel shackles 16, maintains a lock body structure which is maleable and ductile (and thereby resistant to hammering) but, once an attempt is made to saw or drill the body, the metal work-hardens quite appreciably. Consequently, when an attempt is made to saw or drill through the padlock body 10, the stainless steel work-hardens to resist further sawing.

Moreover, the type 300 series stainless steels are resistant to rusting and other corrosive influences, and need not be protected by chromium, cadmium, or other plating. This resistance extends to the entire body structure, thereby insuring that the bores 20, 22, 24 remain rust-free for ready opening.

The composition and powder metallurgy of the type 300 series stainless steel have been widely described in the literature. See, for example, the "Metals Handbook", 8th Edition, chapters on Stainless Steels and Heat-Resisting Alloys; and Kirk & Othmer's "Encyclopedia of Chemical Technology", Second Edition (Interscience), Volume 5 (Chromium and Chromium Alloys), Volume 11 (High-Temperature Alloys), Volume 13 (Metal Treatments), and Volume 16 (Powder Metallurgy). Tabular extracts from the Encyclopedia appear on the tables next following, and exemplify then-current specifications for the 300 series metals.

Composition of Principal Type 300 Series Austenitic Stainless Steels

| Notes | AISI type | Max C, % | Max Mn, % | Max Si, % | Cr, % | Ni, % | Other |
|---|---|---|---|---|---|---|---|
| | 301 | 0.15 | 2.00 | 1.00 | 16.0–18.0 | 6.0–8.0 | |
| m * | 302 | 0.15 | 2.00 | 1.00 | 17–19 | 8–10 | |
| | 302B | 0.45 | 2.00 | 3.00 | 17–19 | 8–10 | |
| n | 303 | 0.15 | 2.00 | 1.00 | 17–19 | 8–10 | 0.15 min S |
| o | 304 | 0.08 | 2.00 | 1.00 | 18–20 | 8–12 | |
| | 304L | 0.03 | 2.00 | 1.00 | 18–20 | 8–12 | |
| | 305 | 0.12 | 2.00 | 1.00 | 17–19 | 10–13 | |
| p | 308 | 0.08 | 2.00 | 1.00 | 19–21 | 10–12 | |
| q | 309 | 0.20 | 2.00 | 1.00 | 22–24 | 12–15 | |
| | 310 | 0.25 | 2.00 | 1.50 | 24–26 | 19–22 | |
| | 310X | 0.08 | 2.00 | 1.50 | 24–26 | 19–22 | |

-continued

Composition of Principal Type 300 Series Austenitic Stainless Steels

| Notes | AISI type | Max C, % | Max Mn, % | Max Si, % | Cr, % | Ni, % | Other |
|---|---|---|---|---|---|---|---|
| | 314 | 0.25 | 2.00 | 3.00 | 23–26 | 19–22 | |
| r | 316 | 0.08 | 2.00 | 1.00 | 16–18 | 10–14 | 2.0–3.0 Mo |
| | 316L | 0.03 | 2.00 | 1.00 | 16–18 | 10–14 | 2.0–3.0 Mo |
| | 317 | 0.08 | 2.00 | 1.00 | 18–20 | 11–15 | 3.0–4.0 Mo |
| o | 321 | 0.08 | 2.00 | 1.00 | 17–19 | 9–12 | 5XC min Ti |
| t | 347 | 0.08 | 2.00 | 1.00 | 17–19 | 9–13 | 10XC min Nb + Ta |
| | 348 | 0.08 | 2.00 | 1.00 | 17–19 | 9–13 | 10XC min Nb + Ta; 0.10 max Ta |

* From Kirk-Othmer's "Encyclopedia of Chemical Technology" Second Ed., Vol 5, p. 471 (Interscience).

Notes m General purpose stainless steel, frequently designated as 18–8.
n Free machining 18–8 stainless steel (selenium added).
o Low carbon 18–8 stainless.
p Higher corrosion resistance than 18–8.
q Elevated temperature service—(25–12) better than 18–8.
r Improved corrosion resistanace, Molybdenum added.
o Titanium stabilized 18–8 stainless for high temperature service.
t Columbium stabilized 18–8 stainless, for use at elevated temperatures and in stainless steels to be welded.

Typical Properties of Type 300 Series Austenitic Stainless Steels** From Powder Metals

| Material | PMPA[a] designation | Density, g/cm³ | Condition[b] | Ultimate tensile strength, 1000 psi | Yield strength, 1000 psi | Elongation, % | Transverse fiber strength, 1000 psi | Shear strength, 1000 psi | Impact strength, ft-lb | Hardness, Rockwell | Compressive yield strength, 1000 psi |
|---|---|---|---|---|---|---|---|---|---|---|---|
| stainless steel | | | | | | | | | | | |
| 302 | | 6.2–6.5 | | 35–50 | | 2.5 | | | | 40-60-RB | 20–40 |
| 303L | SS-303L-P | 6.0 | AS | 35 | 32 | 2.0 | | | | | |
| 316 | | 6.2–6.6 | | 55 | | 2.0 | | | | | 50 |
| 316L | SS-3166-R | 6.65 | AS | 58 | 51 | 8.1 | 135 | 20 | 4.5 | 65RB | |

[a]Powder Metallurgy Parts Association
[b]AS designates As Sintered
**From Kirk-Othmer's "Encyclopedia of Chemical Technology" Second Ed., Vol. 18, p. 422 (Interscience)

According to the tables, the austenitic stainless steels useful in the present invention contain about 16–26 weight percent chromium, about 8–22 weight percent nickel, and a maximum of 0.45% carbon and 2.0% manganese. As noted earlier, stainless steels within this range are austenitic, and therefore are not susceptible to thermal hardening but are remarkably susceptible to work hardening, a property which is availed of in accordance with the present invention.

Fabrication of the lock body 10 from powder-form stainless steel alloy follows conventional procedures. The powder, advantageously having a mesh size below 325 (U.S. Standard Screen), is first compacted, usually without a binder, at a pressure within the range of 10–50 tons per square inch, preferably about 20–40 tons per square inch. Normally compression is initiated at room temperature, but hot-pressing techniques may also be used. After withdrawing the green or compact compressed body form, it is then sintered at a temperature just below its melting point; depending upon the particular stainless steel, temperatures on the order of 2,000°–2350°F for times of 30–60 minutes embrace the normal operating range, with about 2300°F being most desirable. Sintering is desirably conducted under a protective gas atmosphere using, for example, hydrogen, helium, or argon to maintain oxygen-free conditions.

It has been found, based on extensive testing, that 316 stainless steel provides the optimum balance of ease of powder metallurgy fabrication, of machineability where required (e.g. to drill the bores 28, 30, 54, and the hold for the pin 21), and work-hardenability of the final lock.

Locks made according to the invention are truly maximum security padlocks, but may be made at costs substantially below those of corresponding monolithic bodied locks. They are, moreover, exceptionally attractive by reason of their stainless steel surfaces, which attraction may be augmented by brushing, polishing, or the like. Further, they retain this appearance--as well as their un-corroded internals--upon prolonged exposure to the atmosphere under conditions which would cause unacceptable rusting of hardened steel bodied locks. It is apparent, therefore, that the objectives of the invention have been met.

I claim:

1. In a maximum security lock of the type having a monolithic lock body with a plurality of bores therein, hardened steel shackle means receivable in first and second bores, one leg of said shackle means being non-removable and the other being removable, a pair of shackle-fixing members within another bore in said lock body for preventing and for permitting opening of said shackle, and a key-receiving lock mechanism in an additional bore in said body which, when actuated by a proper key inserted in the lock mechanism, permits retraction of said shackle-fixing members and opening of the padlock, the improvement wherein said monolithic lock body is made of a compressed and sintered powdered metal alloy of an austenitic stainless steel containing about 16–26 weight percent chromium, about 8–22% nickel, and a maximum of 0.45% carbon and 2.0% manganese, whereby the resulting lock body is substantially softer than said shackle means, but, when an attempt is made to saw through said body, said stainless steel work-hardens to resist further sawing.

2. The lock of claim 1 wherein said shackle means fixing members comprise a pair of hardened metal balls, and said padlock includes a rotatable retaining member connected to said lock mechanism, said retaining member having indentations thereon so that rotation with the lock mechanism aligns said indentations with said hardened metal balls providing clearance therefor and permitting removal of said removable shackle leg.

3. The lock of claim 2 wherein said hardened steel balls are in a bore in said lock body intersecting the bores receiving said hardened steel shackle means.

4. The lock of claim 1 wherein said hardened steel shackle means is generally a one piece U-shaped member, the non-removable leg of said shackle being longer than said removable leg, said non-removable leg having a removal-preventing neck near its terminal portion.

5. The lock of claim 1 wherein said austenitic stainless steel is a type 300 series stainless steel.

6. The lock of claim 5 wherein said stainless is type 316 stainless steel.

* * * * *